United States Patent [19]

Gentry

[11] Patent Number: 4,506,858

[45] Date of Patent: Mar. 26, 1985

[54] WIRELINE VALVE INNER SEAL

[75] Inventor: Ernest B. Gentry, Dallas, Tex.

[73] Assignee: Otis Engineering Corporation, Dallas, Tex.

[21] Appl. No.: 499,341

[22] Filed: May 31, 1983

[51] Int. Cl.[3] ..... E21B 33/06

[52] U.S. Cl. ..... 251/1 A; 251/1 R; 277/166; 277/167.5

[58] Field of Search ..... 251/1 R, 1 A; 277/166, 277/167.5

[56] References Cited

U.S. PATENT DOCUMENTS

| | | | |
|---|---|---|---|
| 778,591 | 12/1904 | Layne | 251/1 A |
| 1,641,921 | 9/1927 | Crowell | 251/1 A X |
| 2,194,259 | 3/1940 | Allen | 251/1 A |
| 2,746,710 | 5/1956 | Jones | 251/1 A |
| 4,214,605 | 7/1980 | Hardgrave | 137/495 |
| 4,416,441 | 11/1983 | Van Winkle | 251/1 A |
| 4,428,592 | 1/1984 | Shaffer | 277/230 |

*Primary Examiner*—Samuel Scott
*Assistant Examiner*—Allen J. Flanigan
*Attorney, Agent, or Firm*—Roland O. Cox

[57] ABSTRACT

Disclosed is a ram assembly for a wireline blowout preventer, not requiring wireline guides, and having an improved inner seal and outer seal. The improved inner seal utilizes molded in layered fabric reinforcement and a unique retainer plate configuration to enable a closed blowout preventer or preventer closed on wireline to seal extremely high pressures with less closing force and no damage to the wireline.

12 Claims, 5 Drawing Figures

WIRELINE VALVE INNER SEAL

BACKGROUND

This invention is an improved inner ram seal for a blowout preventer type valve, useful on wellheads, which may be actuated to seal on a like seal in an opposing preventer ram or on wireline passing through the preventer, closing the well.

U.S. Pat. No. 4,265,424 to Jones and U.S. Pat No. 4,323,256 to Miyagishima show examples of ram seals configured to seal around pipes passing through a blowout preventer.

The inner seals used in the wireline blowout preventer rams of U.S. Pat. No. 4,214,605 to Hardgrave and U.S. Pat. No. 4,325,534 to Roark and Hayter seal around wireline and have been found not capable of sealing when well pressures below the closed rams are in the 15,000 to 20,000 psi range. These ram assemblies also require attachment of guides to each ram to cam the wireline into a small sealing area in the middle of the inner seal sealing face, between notches in the upper and lower inner seal retainer plates. Guide edges dragging across wire as the preventer is closing abrade and may damage the wire. As sealing material does not extend from the retainer plates on these inner seals, providing a large seal surface, the wireline must be inside narrow retainer plate notches when the rams are closed to allow only the resilient sealing material to contact the wire and not the metal seal retainer plates, which would easily damage or cut the wire passing through the blowout preventer.

SUMMARY

The present invention provides an inner molded seal for a blowout preventer ram wherein the resilient seal material is reinforced with layers of fabric molded inside and has a seal surface on one side. Upper and lower generally rectangular metal retainer plates, mold bonded to the seal material, are shallowly cut back from the seal surface side near full length along one long edge of each retainer plate. Tabs projecting from each retainer plate at both ends of the cut back are of sufficient contact face area so that ram closing forces do not crush them and allow the plates to contact wireline passing through the preventer, to damage or cut it. The retainer plates are positioned on the seal material and bonded with tabs back from the seal surface. The layers of reinforcing fabric provide sufficent rigidity to the resilient inner seal material to prevent 20,000 pounds per square inch and greater sealed pressures from deforming the inner seals or their sealing faces sufficiently to cause any leak. The fabric provides sufficient rigidity in the resilient seal material if the inner seal seals full face on a like opposing inner seal in a preventer or the inner seals also seal around a wireline.

Inward ram closing forces required to close a preventer and effect a seal between improved inner seals have been greatly reduced as the present invention inner seal eliminates the need for ram wire guides which expend closing forces, needlessly abrading wire. The extention of seal material from retainer plates allows greater sealing compression to be induced into the inner seals before retainer plates engage; therefore, greater pressures may be sealed.

The improved inner seal is housed in a slot across the inner end of a ram body. An outer seal, which is housed in recesses in and a groove over the outer end of the ram body, slidably and sealingly engages the bore for the ram in a blowout preventer body and sealingly engages the outer end of the inner seal when the preventer is closed.

An object of this invention is to provide an improved inner seal for a wireline blowout preventer which will seal extremely high pressures.

Another object is to provide an improved inner seal having a large sealing surface area.

Another object of this invention is to provide an inner ram seal with retainer plates which do not contact or damage wireline the preventer is closed on.

Another object of this invention is to provide an improved seal for a ram assembly not requiring wire guides.

Also an object of this invention is to provide an improved inner seal for a ram assembly requiring less closing force to seal extremely high pressures.

DRAWING DESCRIPTION

PREFERRED EMBODIMENT DESCRIPTION

Figure 1:
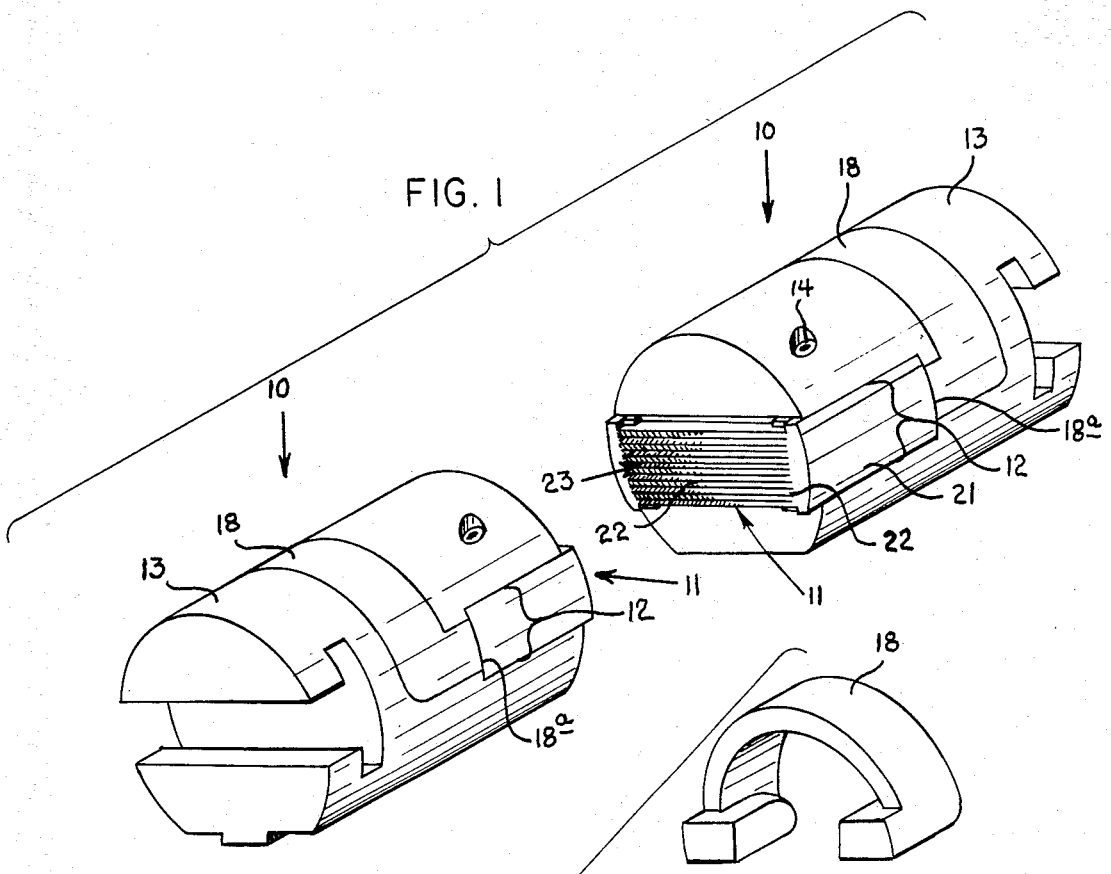
FIG. 1 is an isometric drawing of a pair of cooperating ram body assemblies, each including an inner seal of this invention.
Figure 2:
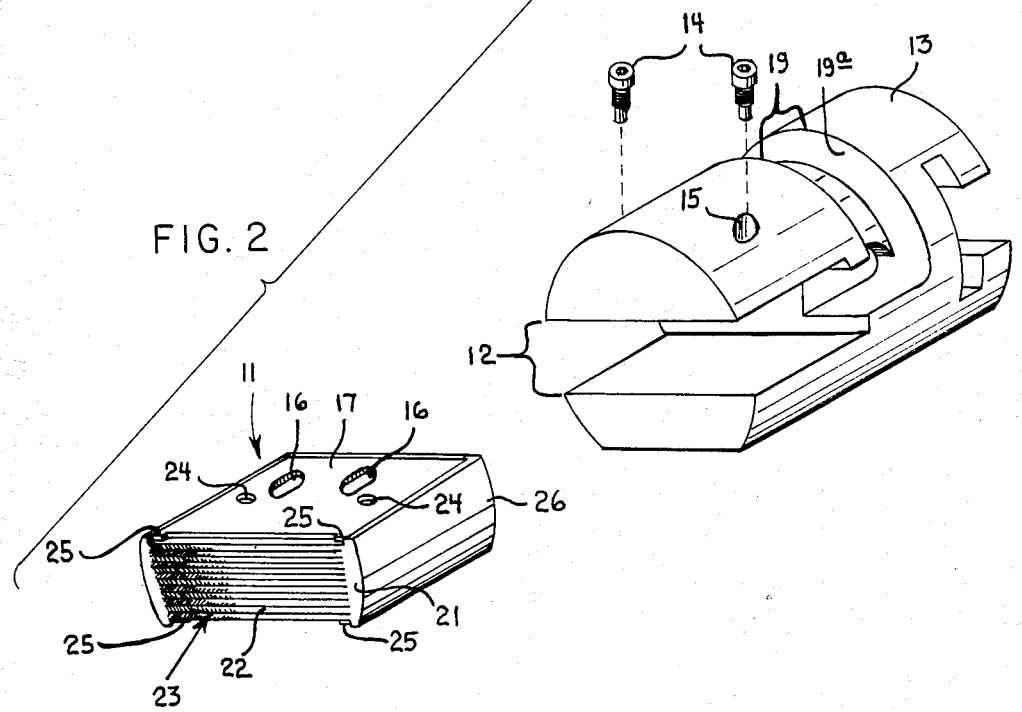
FIG. 2 is an exploded isometric drawing of a ram body assembly of FIG. 1.

FIG. 1 shows an opposing pair of ram assemlies 10, each having an improved molded inner seal 11 of this invention, slidably mounted in a slot 12 in the inner end of the ram body 13, and retained therein by screws 14 (FIG. 2) engaged in threaded holes 15 in the body and protruding into slots 16 in the inner seal metal upper retainer plate 17.

An outer seal 18 is positioned in a groove 19 (FIG. 2) over the upper half of each ram body with each outer seal end engaging the outer end of the inner seal at 18*a*, FIG. 1.

Figure 4:
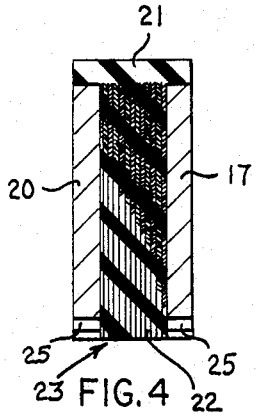
FIG. 4 is a sectioned drawing along line 4—4 of FIG. 3.
Figure 5:
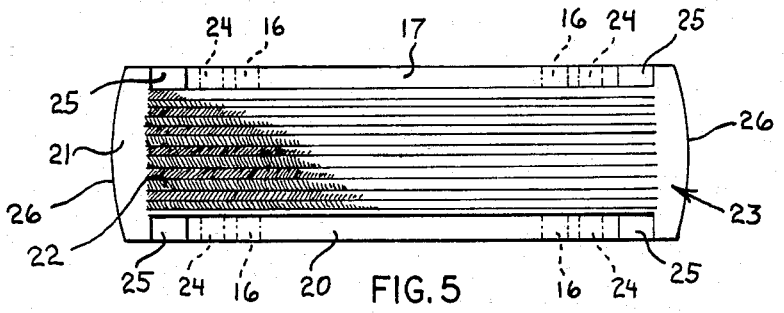
FIG. 5 is a front view drawing of the improved seal of the present invention.

Each inner seal has an upper retainer plate 17 and an identical lower metal retainer plate 20 (FIGS. 4 and 5) mold bonded to molded resilient sealing material 21 in which approximately 12 layers of reinforcing fabric 22 are molded. A sealing surface 23 is provided on the inner end of each seal.

Each generally rectangular retainer plate 17 and 20 has a pair of spaced apart slots 16 near their outer edge for engagement of retaining screws 14 which slidably position and retain the inner seals in body slot 12. As the upper and lower retainer plates are identical, the inner seals may be installed inverted in a ram body. Sliding movement of the inner seal relative to a ram body is limited by the ends of the retainer plate slots contacting the retainer screws. Each retainer plate also has a pair of spaced apart holes 24 into which pins in the mold extend to properly position the retainer plates in the inner seal mold cavity during molding. The inner edge of each retainer plate is cut back, a little more than a wireline radius and almost all way across, leaving projecting tabs 25 at both ends.

The resilient seal material 21 selected for the inner seal of this invention was a Buna N Nitrile synthetic rubber, well known for good service in hydrocarbon wells and with good molding properties.

Woven reinforcing fabric of E. I. Dupont's Kevlar polyaramid synthetic fibers and nylon along with cotton duck were molded in the seal material. Combinations of two top and two bottom layers of Kevlar with the rest of the layers nylon fabric and two top and bottom layers of Kevlar fabric and inner layers alternately cotton duck and nylon were all tested successfully. Inner seals having all Kevlar layers and all cotton duck layers were also successfully tested. As the cotton duck fabric is least costly, it is preferred for inner seal resilient material reinforcement.

Figure 3:
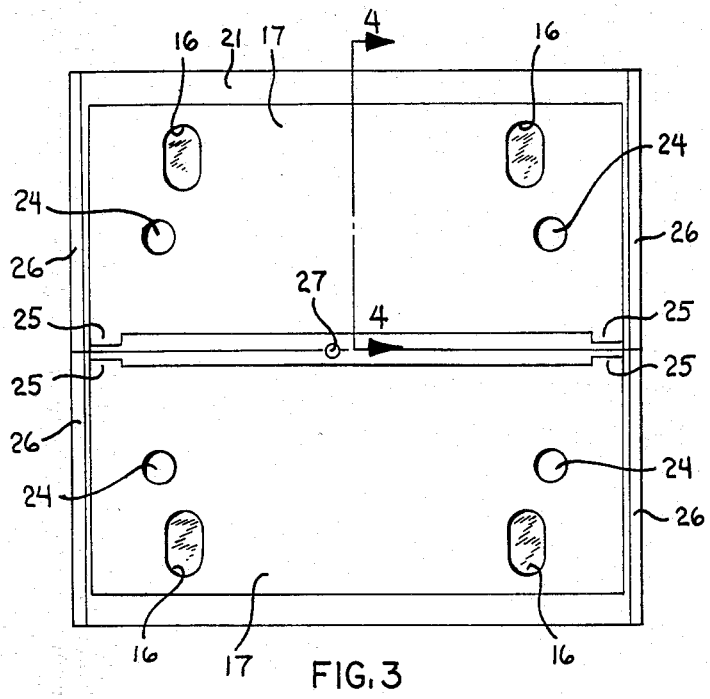
FIG. 3 is a drawing of the top view of two opposing inner seals of this invention, sealingly engaging each other and a wireline as in a preventer closed on wireline.

The ram assemblies 10 are usually opposedly mounted in and reciprocated outwardly and inwardly between open and closed positions in horizontal bores in the wireline valve body by mechanical or hydraulic means. Surfaces 26 on each inner seal are turned to a diameter sealingly engaging the preventer body horizontal bores. Radial compression on the outer seal 18 sealingly engages the slidable outer seal with the ram body and in the preventer body bore. Inward ram closing force, applied by mechanical or hydraulic means, is transmitted to each inner seal through the ends of outer seal 18 at 18*a*, which are compressed between the outer side 19*a* of groove 19 and the inner seal to sealingly engage the outer end of the inner seal, as inner seal inward movement is stopped by seal surface engagement with an improved inner seal in an opposing ram. Increased closing force inward on the ram bodies may compress the ends of the outer seal sufficiently for the outer end of the inner seals to engage the bottom of the ram body slot 12. Sufficient inward force on the ram assemblies presses the inner seal surfaces on opposing ram inner seals together to seal on each other and around wireline 27, FIG. 3, in the vertical bore of the wireline valve and closes the vertical valve bore to flow. Greater closing forces will further compress reinforced seal material until opposing tabs on the retainer plates contact. The upper and lower retainer plate tabs prevent the retainer plate edges from contacting and damaging wireline in the vertical bore of a closed valve.

What is claimed is:

1. An improved inner seal for a wireline valve ram, slidably attachable in a ram body, comprising: upper and lower rectangular retainer plates, each having tabs at both ends along one long edge, said edge being cut back more than a wireline radius almost all the way along forming said tabs, said plates being mold bonded to molded sealing means having a seal surface on one side, said tabbed plate edges being bonded adjacent and parallel to said sealing means seal surface.

2. The inner seal of claim 1 wherein said sealing means comprises: nitrile synthetic rubber with 8 to 16 layers of stacked reinforcing fabric molded therein.

3. The inner seal of claim 2 wherein all fabric layers are cotton duck fabric.

4. The inner seal of claim 3 wherein each retainer plate has a spaced apart pair of slots formed therein.

5. The inner seal of claim 4 wherein each retainer plate is made of metal.

6. The inner seal of claim 5 wherein each retainer plate has a spaced apart pair of holes therethrough.

7. The inner seal of claim 2 wherein the two top and two bottom fabric layers are polyaramid fabric and the inner layers are alternately cotton duck fabric and nylon fabric.

8. The inner seal of claim 2 wherein the two top and two bottom fabric layers are polyaramid fabric and the inner layers are nylon fabric.

9. The inner seal of claim 2 wherein all fabric layers are polyaramid fabric.

10. An improved inner seal for a wireline valve ram, slidably attachable in a ram body, comprising: an upper rectangular retainer plate having a long edge cut back almost all the way along forming tabs at both ends of said edge, and having a pair of spaced apart slots formed therein, said upper plate being mold bonded to resilient sealing material reinforced with 8 to 16 stacked fabric layers molded therein and having a seal surface on one side, said sealing material being mold bonded to a lower rectangular retainer plate having a long edge cut back almost all the way along forming tabs at both ends of said edge and having a pair of spaced apart slots formed therein, said tabbed plate edges being bonded adjacent and parallel to said sealing material seal surface.

11. The improved inner seal of claim 1 slidably mounted and retained in a ram body with screws and an outer seal mounted on said body.

12. The improved inner seal of claim 10 slidably mounted and retained in a ram body with screws and an outer seal mounted on said body.

* * * * *